United States Patent [19]

Baugh et al.

[11] Patent Number: 4,805,698

[45] Date of Patent: Feb. 21, 1989

[54] PACKER COOLING SYSTEM FOR A DOWNHOLE STEAM GENERATOR ASSEMBLY

[75] Inventors: John L. Baugh, Huntsville; Frank X. Mooney, The Woodlands, both of Tex.; Joseph E. Vandevier, Claremore, Okla.

[73] Assignee: Hughes Tool Company, Houston, Tex.

[21] Appl. No.: 121,485

[22] Filed: Nov. 17, 1987

[51] Int. Cl.[4] ..... E21B 43/24

[52] U.S. Cl. ..... 166/272; 166/60; 166/65.1; 166/188; 166/303

[58] Field of Search ..... 166/58, 59, 60, 61, 166/65.1, 133, 188, 189, 272, 273, 275, 302, 303

[56] References Cited

U.S. PATENT DOCUMENTS

| | | | |
|---|---|---|---|
| 2,998,069 | 8/1961 | Stephens | 166/61 |
| 3,045,099 | 7/1962 | Bowman et al. | 166/60 |
| 3,131,763 | 5/1964 | Kanetka et al. | 166/60 |
| 4,078,613 | 3/1978 | Hamrick et al. | 166/303 |
| 4,185,691 | 1/1980 | Tubin et al. | 166/250 |
| 4,411,618 | 10/1983 | Donaldson et al. | 166/59 |
| 4,694,907 | 9/1987 | Stahl et al. | 166/65.1 |

*Primary Examiner*—Jerome W. Massie, IV
*Assistant Examiner*—Terry Lee Melius
*Attorney, Agent, or Firm*—James E. Bradley

[57] ABSTRACT

A steam generator is located downhole in a well for generating steam to cause viscous crudes to flow out adjacent wells. A packer is mounted above the steam generator. A connector box is located between the packer and the steam generator. An electrical cable extends alongside tubing into the well and into a window in the tubing located just above the packer. The cable extends through a passage in the packer and into the connector box. Feedthrough connectors in the connector box connect the power cable with lead wires extending upward from the steam generator. Cooling fluid passages in the packer allow circulation of cooling fluid from the surface to cool the components. The packer is hydraulically set by water supplied to the cooling fluid passages. A disk ruptures after the packer has been set to enable circulation of the cooling fluid.

6 Claims, 10 Drawing Sheets

PACKER COOLING SYSTEM FOR A DOWNHOLE STEAM GENERATOR ASSEMBLY

CROSS REFERENCE TO RELATED APPLICATION

This application is being filed simultaneously with an application entitled "COMPLETION SYSTEM FOR A DOWNHOLE STEAM GENERATOR", our file number, 104-402, Ser. No. 121,560 filed Nov. 19, 1987, inventor Joseph E. Vandevier, which contains some common subject matter.

BACKGROUND OF THE INVENTION

1. Field of the Invention:

This invention relates in general to a system for generating steam downhole in oil wells, and in particular to a packer and electrical connector apparatus used with a steam generator.

2. Description of the Prior Art:

Steam is used in some cases to facilitate the production of oil from reservoirs having very viscous crude. In the prior art, steam is generated at the surface and pumped down tubing in injection wells. The steam flows through perforations in the casing of the injection well to heat the crude and force it to flow to producing wells.

One disadvantage of steam injection systems is the energy loss which occurs as the steam cools while being pumped from the surface down to the perforations. This is particularly a problem in deeper wells.

Proposals have been made to pump water down the well and generate the steam downhole. This would avoid the heat loss that occurs while the steam is being pumped down the well in conventional systems. The downhole steam generator would generate the steam using high voltage electrical power supplied through electrical cable extending down into the well. A packer above the steam generator would prevent the steam from flowing back up the annulus of the well.

One problem presented by a downhole steam generator is providing the electrical connections. Conventional downhole electrical connections are unable to withstand the high temperatures at the voltage and power levels required. The power requirements for a downhole steam generator are high, up to 7200 volts and 240 amps. The temperatures are high, possibly exceeding 600 degrees F.

Packers are available that have feed through mandrels for electrical wires to be connected for purposes other than downhole steam generators. The feed through mandrel is located to one side of the main conduit in the packer for the tubing. The feed through mandrel has insulated conductor rods extending through the packer. The lower end of the upper section of the cable is connected to the upper end of the connector rod. The upper end of the lower section of cable below the packer is connected to the lower end of the conductor rod.

The conventional feed through mandrel would not be acceptable for use in a downhole steam generator system. The high temperatures would cause deterioration of the elastomeric insulators in the feed through mandrel. Also, the feed through mandrel has a rather small diameter, necessitating that the three conductors from the power cable be spaced quite close to each other.

This results in the possibility of insulation failure between the conductors because of the high voltage.

SUMMARY OF THE INVENTION

In this invention, a connector box is located between the downhole steam generator and the packer. The connector box is an insulated sealed housing that extends downward from the packer. The connector box communicates with the interior of the packer and with the suspension tubing that extends upward from the packer.

The power cable extends down from the surface alongside the suspension tubing until a point a short distance above the packer. At that point, the power cable extends through a window provided in the suspension tubing. The power cable extends through the interior of the packer and into the connection box. In the connection box, the feed through connections are made.

The packer contains cooling fluid passages for cooling the packer. The passages extend into contact with the connection box for cooling the connection box, as well.

The packer is preferably of the type that is set hydraulically. Liquid is pumped down the tubing and into a fluid passage, where it applies pressure to a piston. The piston operates mechanisms to set the packer. A rupture disk is contained in the fluid passage. Once the packer is set, increased pressure applied from the surface ruptures the disk and allows cooling fluid to circulate through the passages. The fluid passages discharge at the top of the packer to flow back up to the surface.

DESCRIPTION OF THE PREFERRED EMBODIMENT

Figure 1A:
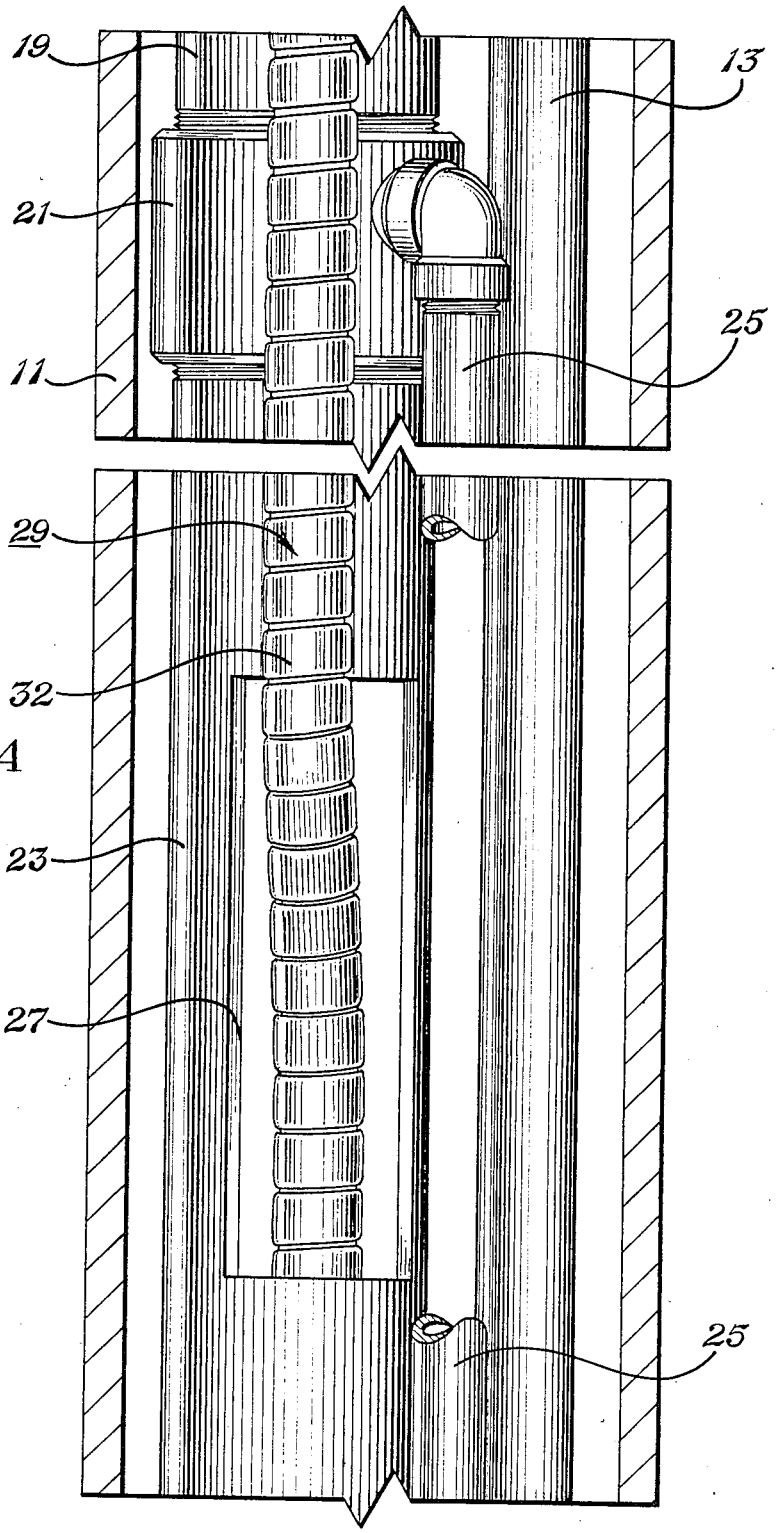
FIGS. 1A, 1B and 1C are a side view, partially in section, of a completion system for a downhole steam generator constructed in accordance with this invention.

Referring to FIG. 1A, the well contains casing 11. A water supply tube or line 13 will extend from the surface down through the casing 11 to a steam generator 15, shown in FIG. 1C. The water supply line 13 is offset from the axis of the casing 11. The steam generator 15 is not shown in detail. It will have electrodes for heating the water supplied through the water supply line 13 sufficiently to cause steam to flow into the earth formation.

Figure 1B:
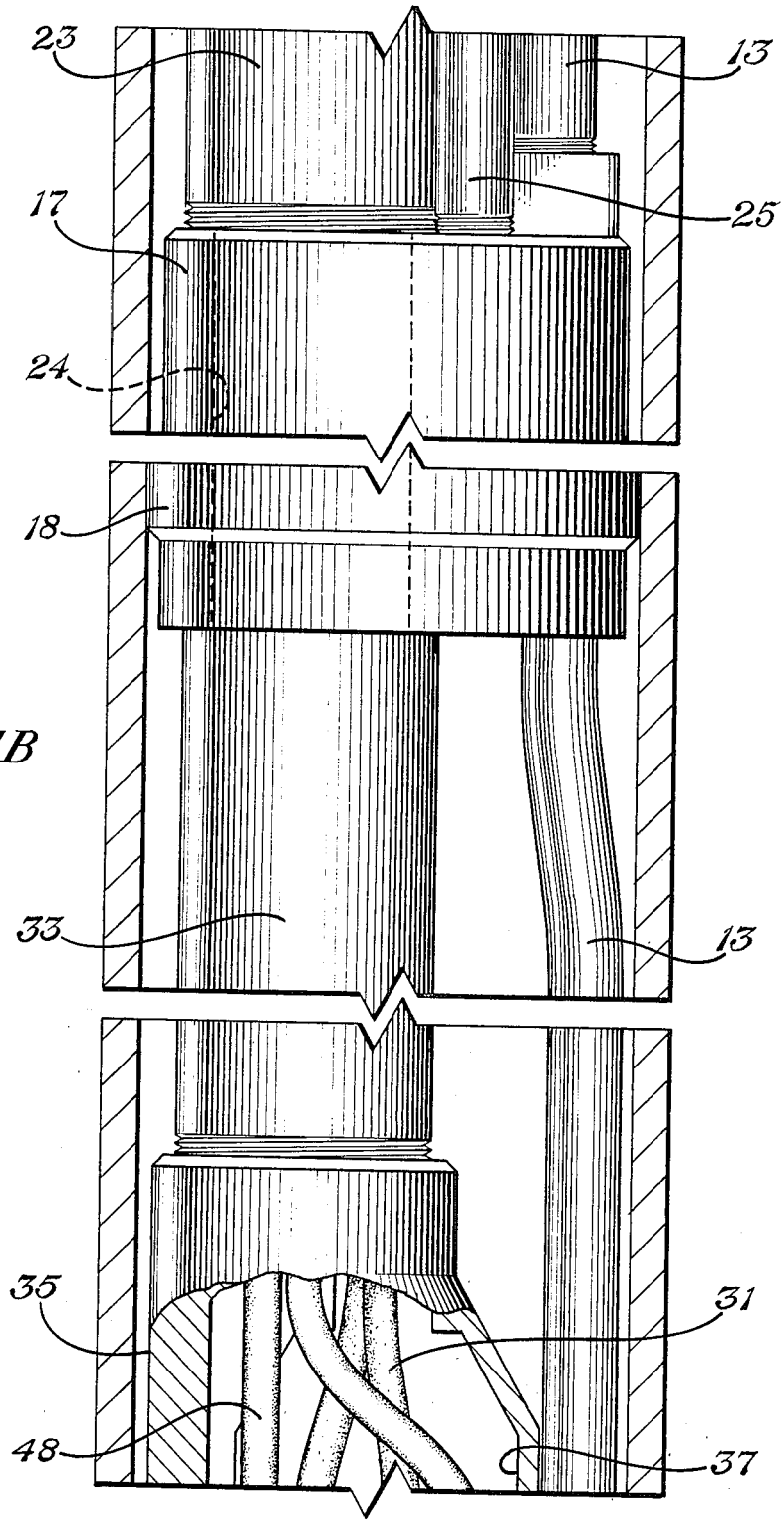

As shown in FIG. 1B, a packer 17 is located above the steam generator 15. The packer 17 will be a high temperature packer having an elastomeric sealing element 18 which is expanded into sealing engagement with the casing 11. Packer 17 is preferably of a type that is set by hydraulic pressure, and once set, the sealing element 18 will remain in place even though the hydraulic pressure is relieved. In FIG. 1B, the packer 17 is shown only schematically. Details of a second type of packer will be described in connection with FIGS. 3A–3F.

The packer 17 is lowered into place on a string of suspension tubing 19, shown also in FIG. 1A. Tubing 19 is usually at least twice the diameter of the water supply line 13. The tubing 19 extends to the surface and is made up of sections approximately 30 feet in length screwed together.

As shown in FIG. 1A, a coupling 21 connects the tubing 19 to a tubing joint 23, which is also part of the string of tubing 19. Joint 23 is secured to the top of the packer 17 (FIG. 1B) in axial alignment with a passage 24 extending through the packer 17. A setting tube 25 extends from the coupling 21 to the packer 17 (FIG. 1B). A plate (not shown) in the coupling 21 directs water pumped down the tubing 19 into the setting tube 25. The water enters the packer 17 and acts against a conventional setting mechanism (not shown) in the packer 17 to expand the sealing element 18.

As shown in FIG. 1A, a window 27 is formed in the joint 23 directly above the packer 17. A power cable 29 extends from the surface alongside the tubing 19. Power cable 29 enters window 27 and passes straight through the passage 24 in the packer 17, through a conduit 33, and into a connection box 35, shown in FIG. 1B. Power cable 29 has three insulated electrical wires 31 (FIG. 1B). Power cable 29 is wrapped in a metallic outer armor 32. The armor 32 terminates below the passage 24, and the lower ends of the wires 31 protrude a short distance below the armor 32.

Referring to FIG. 1B, conduit 33 is insulated and coaxial with the passage 24. The connector box 35 is mounted to the lower end of the conduit 33. Connector box 35 is a sealed insulated housing in communication with the interior of the conduit 33, the passage 24 and the tubing joint 23. Connector box 35 is cylindrical and has a diameter that is as large as possible, preferably at least three-fourths the inner diameter of the casing 11. The axis of the connector box 35 is offset from the axis of casing 11. The water supply line 13 extends alongside the connector box 35.

Figure 1C:
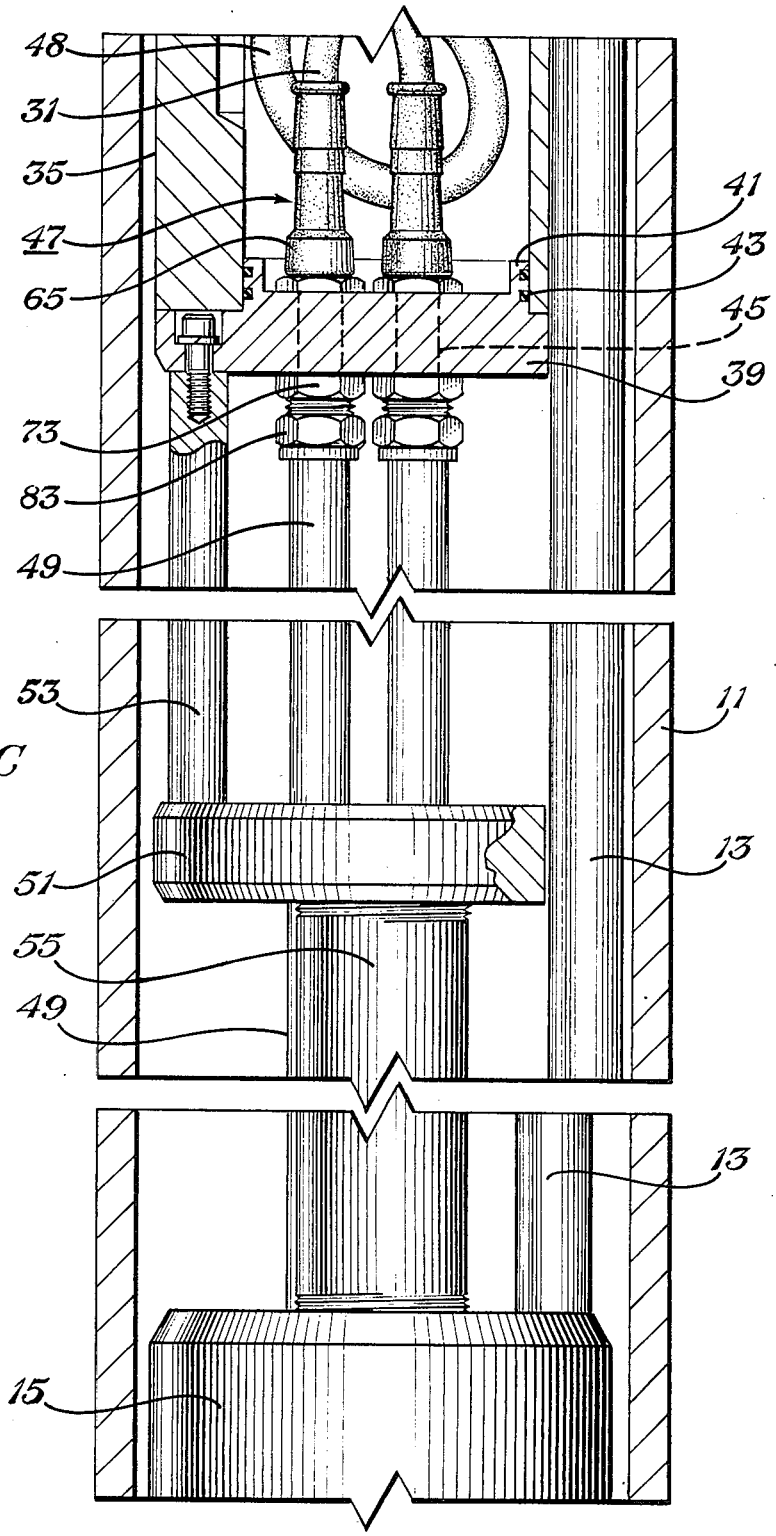

Referring to FIG. 1C, the connector box 35 has a cylindrical sidewall 37 and a bottom connector plate 39. The plate 39 has a neck 41 that is closely received in the sidewall 37. Seals 43 seal the interior of the connector box 35 from the exterior. The connector box 35 is preferably filled with a dielectri electrical insulating fluid.

A cooling fluid tube 48 extends from cooling fluid passages (not shown in the embodiment of FIGS. 1A–1C) in packer 17. The cooling fluid tube 48 extends through the connector box 35 and returns back to the packer 17. Preferably, the cooling fluid passages communicate with the setting tube 25, but are initially blocked from the water being pumped down the setting tube 25 by a blockage means such as a rupture disk (not shown in the embodiment of FIGS. 1A–1C). Once the packer 17 sets, increased pressure ruptures the disk to allow water to be circulated through the packer 17 for cooling. A cooling fluid liquid is then continuously circulated from the surface through the cooling fluid tube 48 to remove heat from the connector box 35.

In the connector box 35, three passages 45 extend through the plate 39, as shown in FIG. 1C. A feed through connector 47 is located in each passage 45. The power cable wires 31 are connected to the feed through connectors 47. Also, wires 49 leading upward from the steam generator 15 are connected to the lower ends of the feed through connectors 47.

An adapter plate 51 is located between the connector box 35 and the steam generator 15. The adapter plate 51 is connected to the connector box 35 by a plurality of rods 53 (only one shown). A support tube 55 extends between the adapter plate 51 and the steam generator 15.

Figure 2:
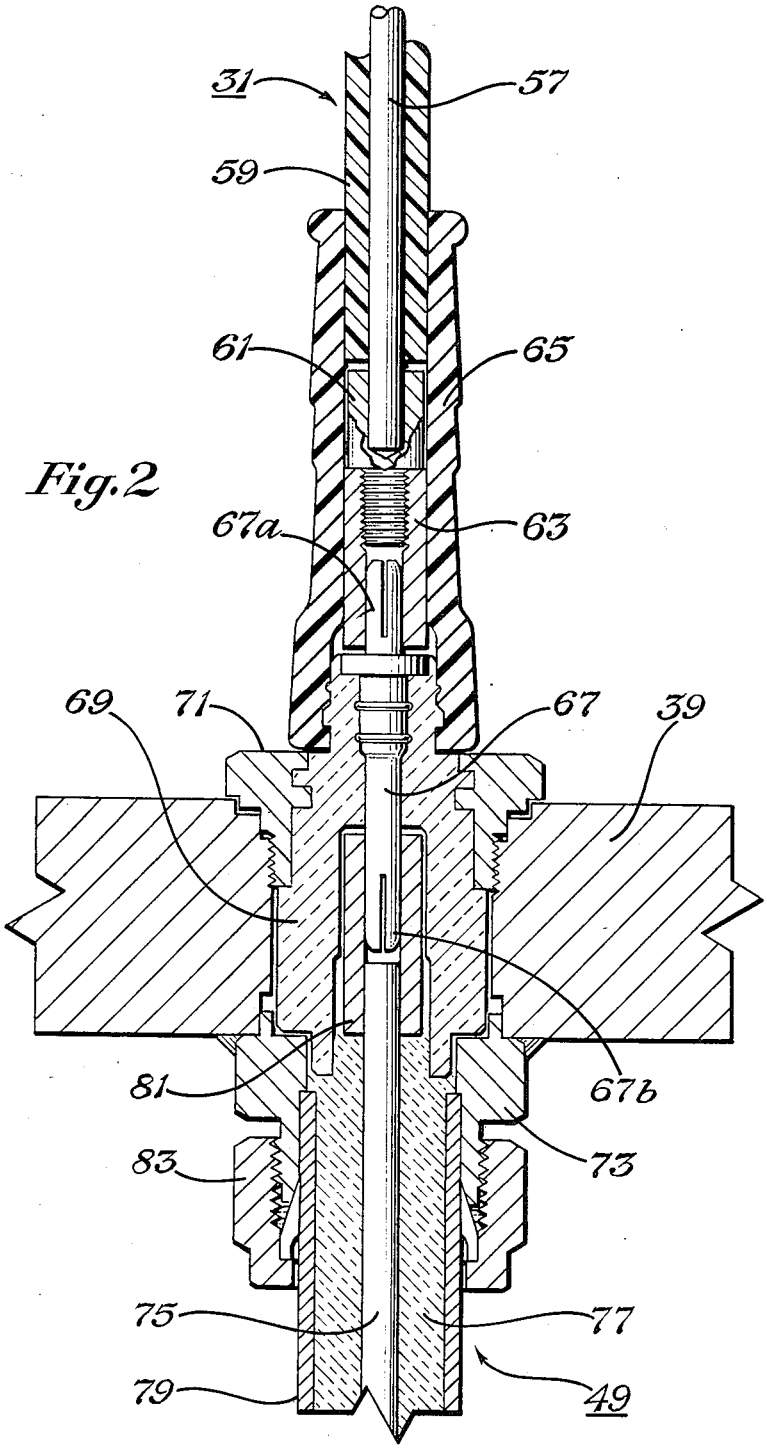
FIG. 2 is an enlarged vertical sectional view of one of the feed through connectors used with the completion system of FIG. 1.

Referring to FIG. 2, each insulated wire 31 from the power cable 29 (FIG. 1A) has an electrical conductor 57 located within an insulating jacket 59. A connector 61 having a male threaded end is joined to the lower end of the conductor 57. A female connector 63 has a threaded upper end that screws onto the male end of the connector 61. The lower end of female connector 63 is tubular. The connectors 61, 63 provide an electrical terminal for each wire 31. An elastomeric boot 65 surrounds the connectors 61, 63.

A feed through rod 67 is located in the plate passage 45. The feed through rod 67 has male ends **67*a* and 67*b* on each end. The feed through rod 67 is molded in an insulator 69 that is located within the passage 45. A nut 71 secures the insulator 69 in the passage on the upper end. A fitting 73 is welded to the lower side of plate 39 concentric with each passage 45. Fitting 73 supports the lower end of the insulator 69**.

The wires 49 each include an electrical conductor 75 located within an insulating jacket 77 that is made up of mineral insulation. A steel sheath 79 surrounds the insulating jacket 77. A female terminal or connector 81 is located on the upper end of the steam generator wire 49. A nut 83 engages threads on the fitting 73 to secure the steam generator wire 49 in place on the lower end **67*b* of each feed through rod 67**.

In the operation of the embodiment of FIGS. 1A–1C, the steam generator 15 is assembled with the connector box 35 and packer 17 at the surface. This assembly is lowered on the tubing 19 to the desired level The power cable 29 is lowered at the same time. When at the proper depth, water is pumped down the tubing 19. The water flows through coupling 21 and into the setting tube 25. The water pressure causes the seal 18 of packer 17 to expand and set against casing 11.

Increased water pressure ruptures the rupture disk (not shown in FIGS. 1A–1C), which allows the water to circulate through the tube 48 (FIG. 1B) and back up to the top of packer 17. The water flows up the annular space surrounding the tubing 19. In the embodiment of FIGS. 1A–1C, the feed water for the steam generator 15 is pumped down the feed water supply line 13 separate for the water from cooling.

FIGS. 3A–3F show a second embodiment of the packer 17. The packer 17' has a head 85 which contains three bores. Bore 87 will be secured to the tubing joint 23 (FIG. 1B) and the electrical cable 29 (FIG. 1A) will extend through it. The electrical cable 29 and tubing joint 23 are not shown in FIGS. 3A–3F. Bore 89 will be connected to a conduit (not shown), such as the water supply line 13, for receiving a supply of water from the surface. A bore 91 serves as an outlet to discharge water after it has circulated through the packer 17'.

A pair of hollow tubular mandrels 93, 94 extend downward from each passage 87, 89. The mandrels 93, 94 extend through an upper elastomeric seal element 95. The seal element 95 is located between upper and lower rings 97, 99. The lower ring 99 is connected to an upper cone 101. The upper cone 101 is pinned to the mandrels 93, 94 by a shear pin 103. A slip cage 105 is secured to the upper cone 101 by a shear pin 107.

Figure 3A:
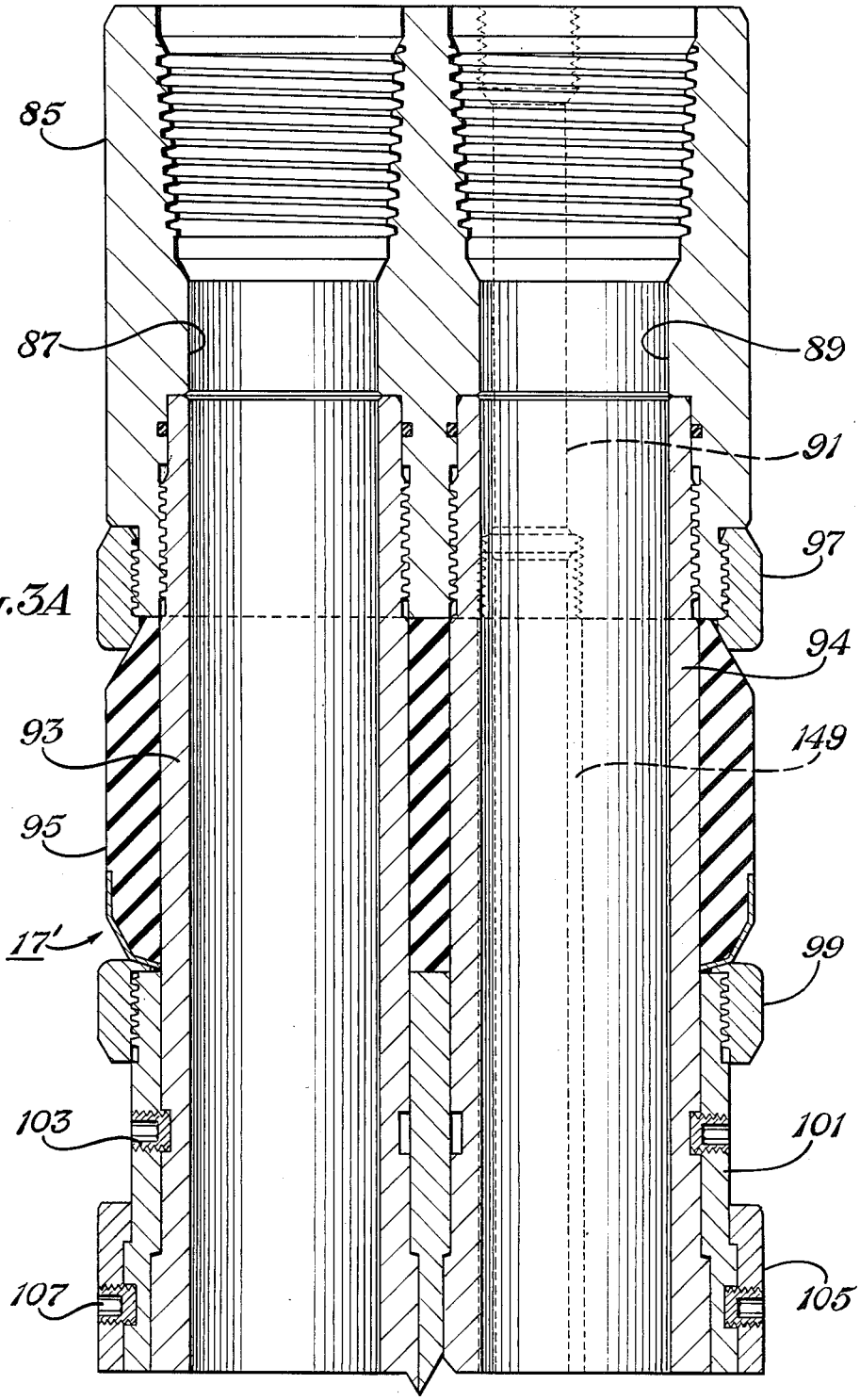
FIGS. 3A–F are a vertical sectional view of a second embodiment of a packer for use with the completion system shown in FIG. 1A–1C.
Figure 3B:
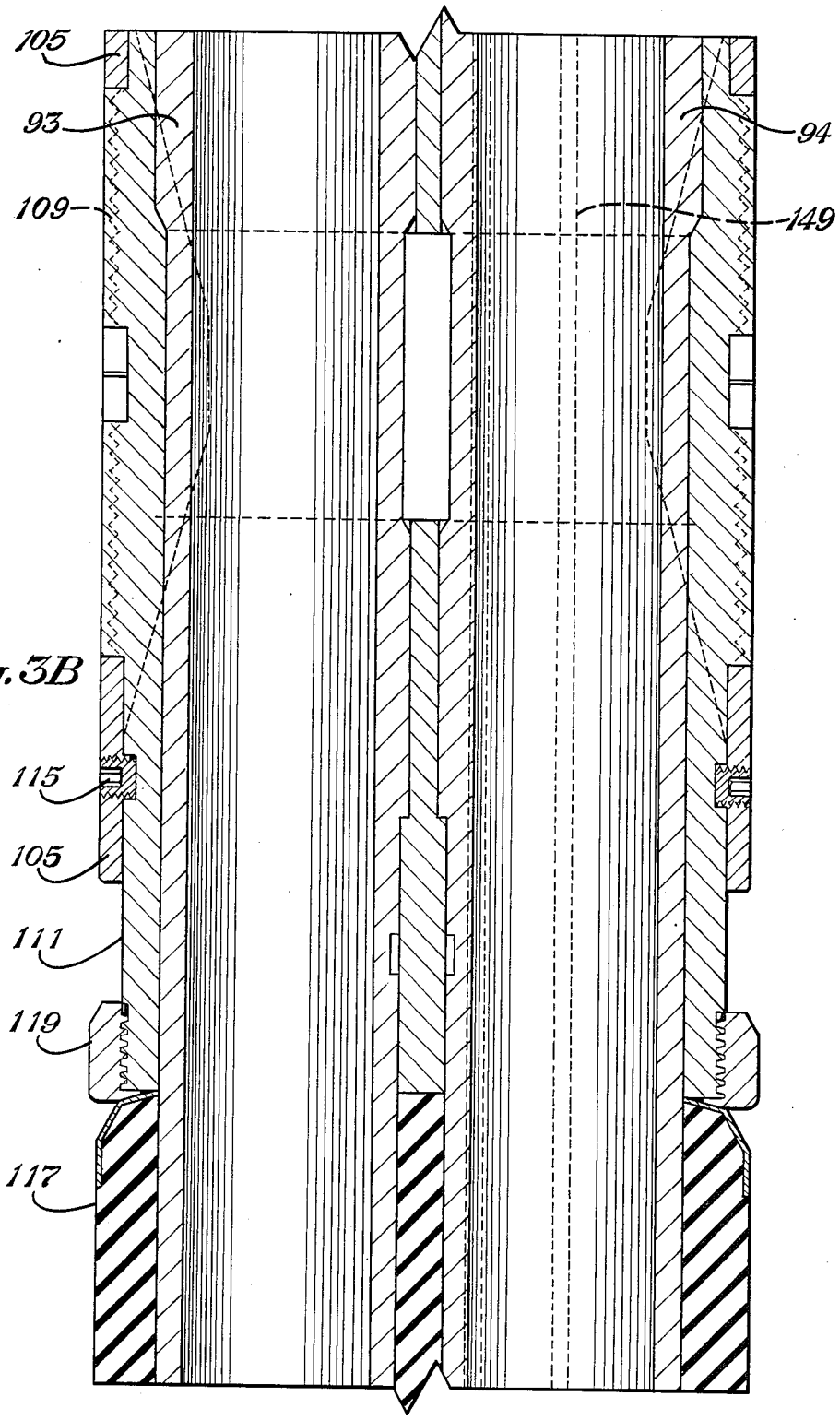

Referring to FIG. 3B, a plurality of dogs or slips 109 are carried in apertures of a slip cage 105, which encloses upper cone 101 and a lower cone 111. As shown by the dotted line, the cones 101, 111 have tapered surfaces which face each other and which contact the slips 109. The slips 109 move outward to grip the casing 11 (FIG. 1A) when the cones 101 and 111 are pushed toward each other. A shear pin 115 connects the slip cage 105 to the lower cone 111.

Figure 3C:
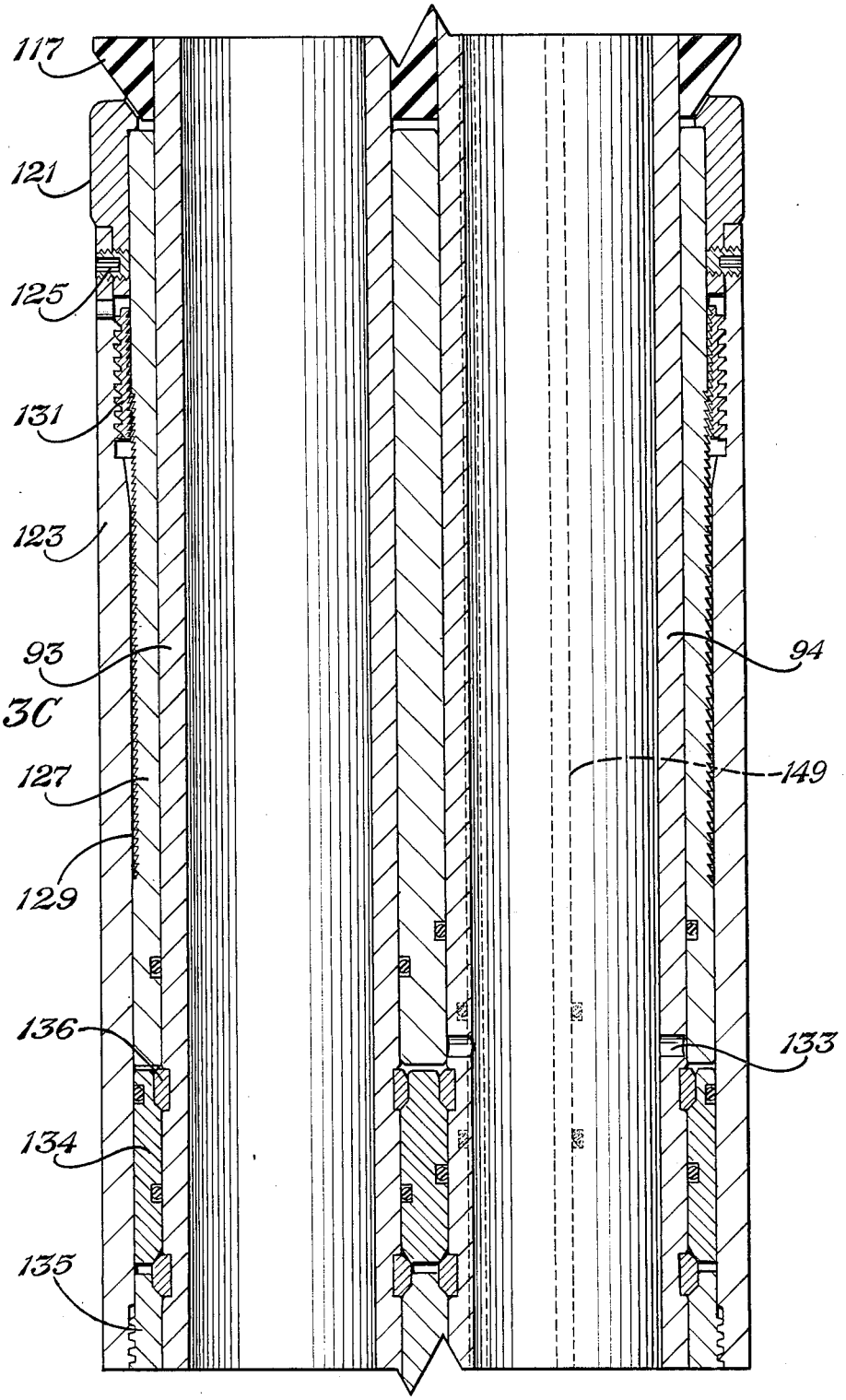

A lower seal element 117, identical to the upper seal element 95, is carried below the slips 109. The lower seal element 117 is located between upper and lower rings 119, 121. Referring to FIG. 3C, a housing 123 is located below the lower ring 121. A shear pin 125 connects the housing 123 to the lower ring 121. A piston 127 is located in the housing 123. The mandrels 93, 94 extend through the piston 127. The piston 127 has grooves 129 on its exterior. A lock ring 131 has grooves on its interior and is threaded to the housing 123. The grooves on the lock ring 131 engage the grooves 129 to allow the piston 127 to move upward, but not downward. A port 133 is located at the lower end of the piston 127. Port 133 communicates with the interior of the mandrel 94.

Figure 3D:
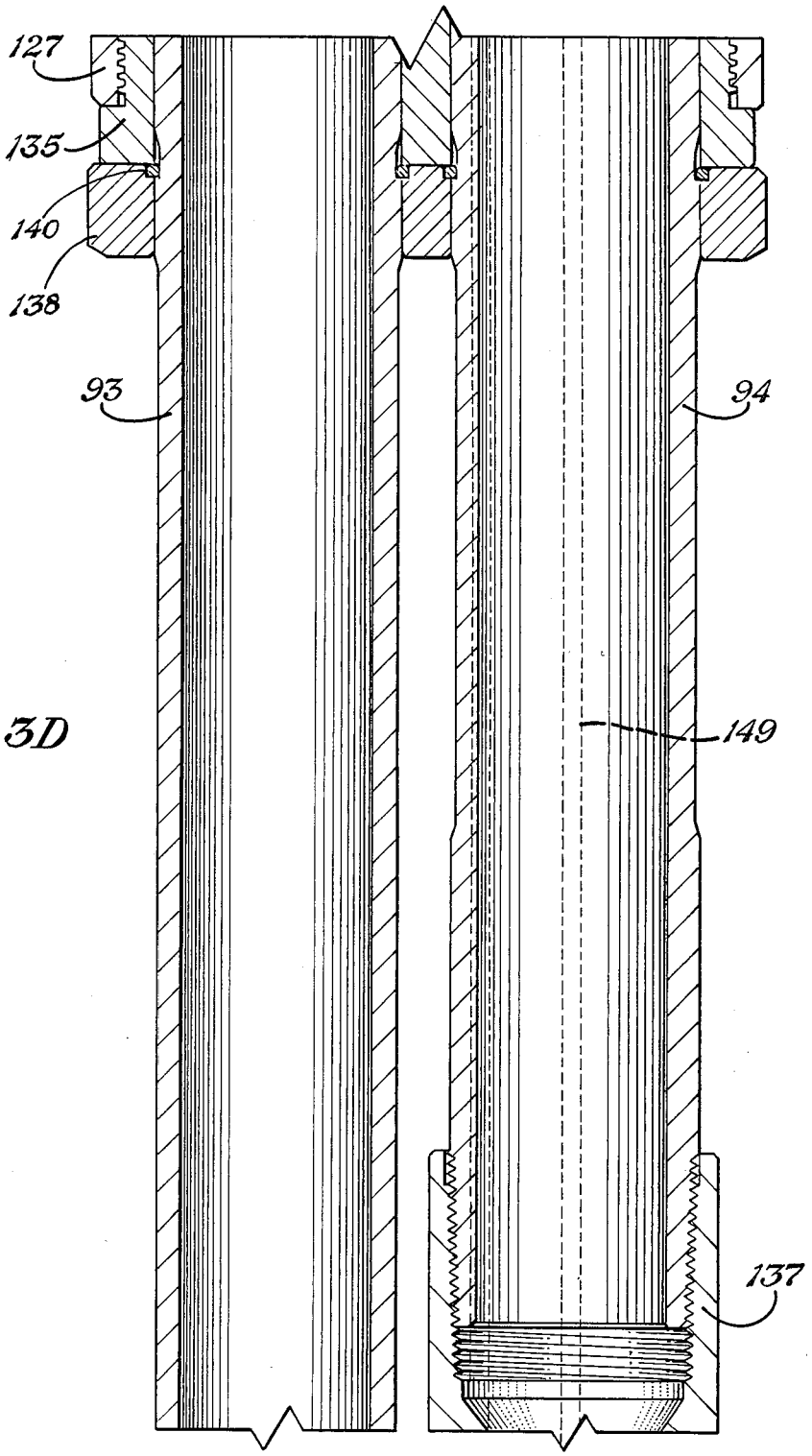
Figure 3E:
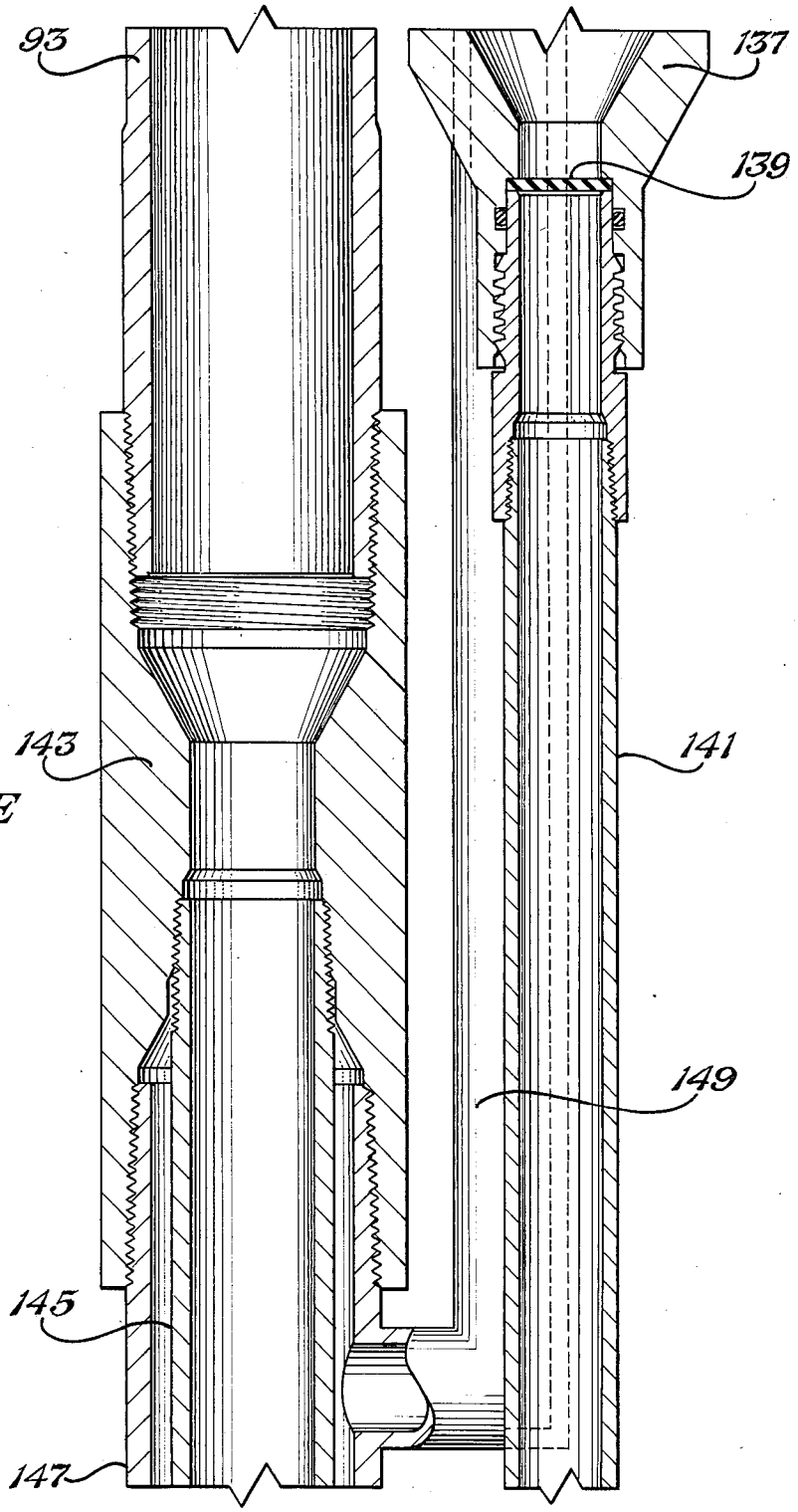

A header 134 is secured rigidly to mandrels 93 and 94 by four snap rings 136. A base 135 secured to the housing 123 below the header 134. As shown in FIG. 3D, the mandrels 93, 94 protrude downward below the header 134 and housing 123. Retainer rings 138 are located below the base 135 and mounted to the mandrels 93, 94 by shear rings 140. Referring to FIG. 3E, the mandrel 94 leads into a reducer adapter 137, which reduces the inner diameter of the passage through the mandrel 94.

A rupture disk 139 is carried at the lower end of the adapter 137. Rupture disk 139 blocks the flow of any fluid below the rupture disk 139 until sufficient pressure is achieved to cause the rupture disk 139 to rupture. The pressure at which it will rupture is greater than the pressure required to set the packer 17'. A tube 141 extends from the rupture disk 139 downward for the passage of the fluid after the rupture disk 139 has ruptured.

Referring still to FIG. 3E, an adapter 143 is located on the lower end of mandrel 93. Concentric pipes 145 and 147 are secured into the lower end of adapter 143. The inner pipe 145 communicates with the interior of the mandrel 93. The outer pipe 147 has an inner diameter that is greater than the outer diameter of the inner pipe 145, providing an annulus. A return tube 149 extends from the annulus upward. The return tube 149 joins the bore 91 (FIG. 3A) as shown by dotted lines in FIGS. 3B–3D, to allow fluid to circulate upward through packer 17'.

Figure 3F:
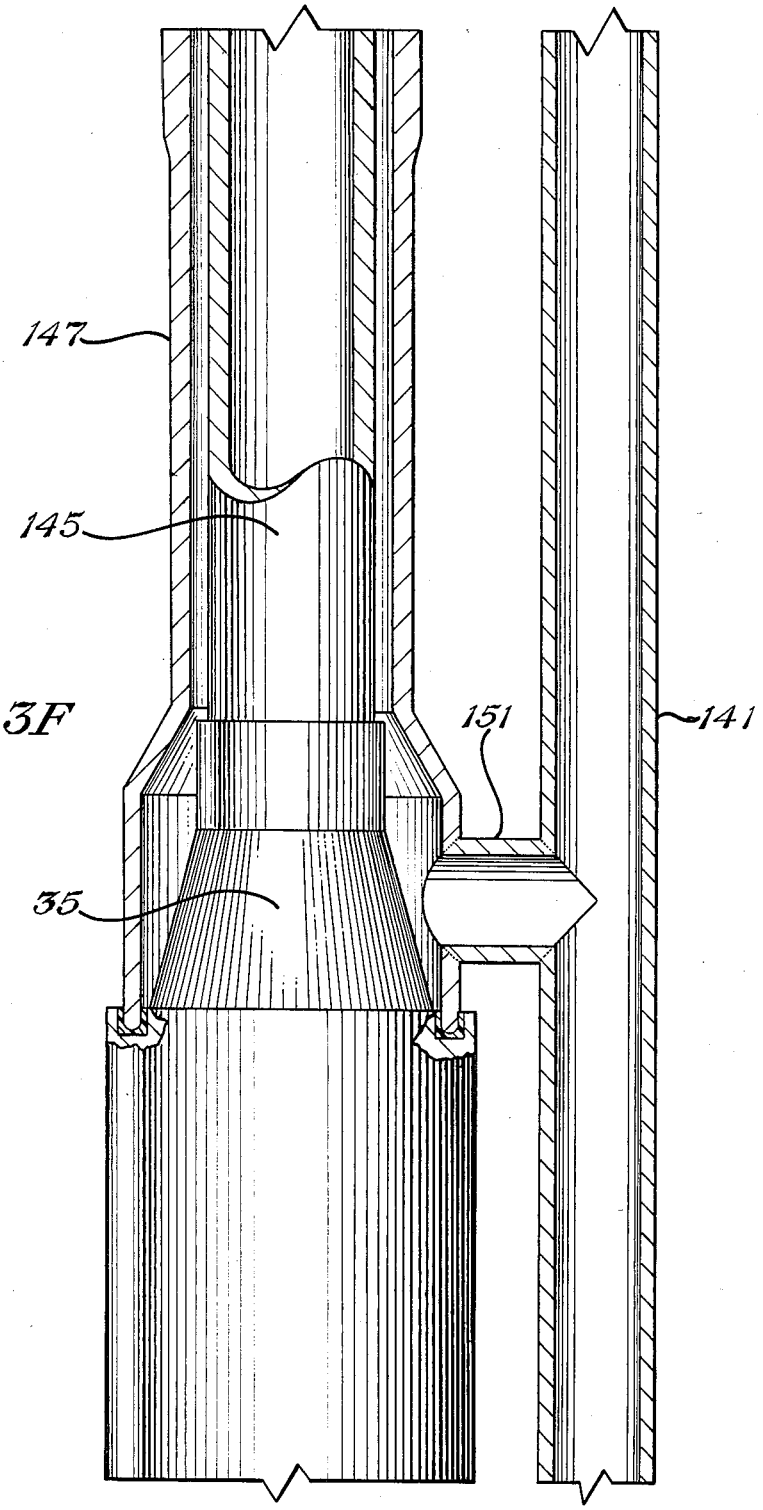

Referring to FIG. 3F, an inlet 151 branches from the tube 141 and joins the outer pipe 147 at a point adjacent the connector box 35. A cooling fluid tube, such as tube 48 shown in FIG. 1B, may extend through the connector box 35 in communication with the annulus surrounding the connector box 35. The tube 141 extends downward from the inlet 151 to supply feed water to the steam generator 15 (FIG. 1C).

In operation, the steam generator 15 is assembled with the connector box 35 and packer 17' at the surface. This assembly is lowered on the tubing 19 to the desired level. The power cable 29 is lowered at the same time. In the embodiment of FIGS. 3A–3F, the separate water supply line 13 (FIG. 1A) may be connected to the bore 89 (FIG. 3A) and lowered with the power cable 29. In the alternative, the bore 89 may be connected to a setting fluid tube 25 (FIG. 1A) which receives water pumped down the tubing 19.

When at the proper depth, water is pumped down the well from the surface. The water flows through bore 89 and into mandrel 94, as shown in FIG. 3A. The water will stop at the rupture disk 139, shown in FIG. 3E. The interior of the mandrel 94 above the port 133 (FIG. 3C) may be considered a setting fluid passage. Referring to FIG. 3C, the water will enter the port 133 and begin pushing upward on the piston 127.

Shear pin 125 will shear, allowing the piston 127 to push the lower retainer ring 121 and lower seal element 117 upward relative to the mandrels 93, 94. The shear pin 115 and shear pin 107 (FIG. 3A) will shear, causing the lower cone 111 to move upward relative to upper cone 101 The slips 109 may start to move outward to engage the casing (not shown). The lower sealing element 117, may start to deform outward to seal against the casing (not shown). The shear pin 103 (FIG. 3A) shears. The lower retainer ring 99 will move toward the upper retainer ring 97, deforming the upper sealing element 95 outward (FIG. 3A). When fully set, the slips 109 will grip the casing 11 and wedge in place, and both sealing elements 95 and 117 will be sealed against the casing. The piston 127 will not be able to retract due to its grooves 129 engaging the lock ring 131. This retains the packer 17' in the set position even if the fluid pressure is removed.

Once set, the pressure of the water for setting the packer 17' is increased enough to cause the disk 139 (FIG. 3E) to rupture. The water pumped from the surface will then flow down the tube 141 (FIGS. 3E, 3F). A large portion of the water will flow to the steam generator 15 (FIG. 1C) for steam generation. A smaller portion will flow through inlet 151 (FIG. 3F) and into the annulus surrounding the connector box 35. The water returns up to the return tube 149, shown in FIG. 3E, flowing through the packer 17'. The water will discharge from the outlet at the bore 91 preferably into the annulus surrounding the tubing 19 (FIG. 1A). The water flows up the annulus to the surface. The feed water, which also serves as the cooling fluid, will continuously circulate through the packer 17' and supply the steam generator 15.

Electrical power is supplied from the surface to the power cable 29. The three phase power passes through the feed through connectors 47 (FIG. 1C) to the steam generator 15. The steam generator 15 heats the water to cause steam which then flows into the formation. The pressure of the water and the heat from the steam cause the crude in the formation to flow up adjacent production wells.

The steam generator 15 can be removed from the well for repair or replacement. Pulling tension on the tubing 19 causes the shear rings 140 (FIG. 3D) to release. This allows the housing 123 (FIG. 3C) to move downward relative to mandrels 93, 94. The elastomeric elements 117, 95 (FIGS. 3A and 3B) are released from compression against the casing. The lower cone 111 (FIG. 3B) moves downward relative to the upper cone 101, allowing the dogs 109 to retract. The entire packer is removed from the well along with the steam generator 15.

The invention has significant advantages. The cooling fluid passages through the packer allow cooling fluid to be circulated to prevent deterioration of the elastomeric components. The cooling fluid passages also cool the connector box and the electrical cable and connections.

While the invention has been shown in only two of its forms, it should be apparent to those skilled in the art, that it is not so limited, but is susceptible to various changes without departing from the scope of the invention.

We claim:

1. An apparatus for providing electrical power to a downhole steam generator in a cased well, comprising in combination:

a packer supported on a string of tubing, the packer having means for sealing against casing in the well and at least one conduit extending longitudinally through the packer;

a connector box mounted below the lower end of the packer, the connector box having a connector plate containing at least one passage;

a plurality of feed through electrical connectors mounted in insulations in the passage in the connector plate;

support means for mounting the steam generator below the connector box;

an aperture located in the sidewall of the tubing immediately above the packer;

an electrical cable extending from the surface alongside the tubing into the aperture and through the conduit into the connector box, the electrical cable having a plurality of electrical conductors, each of which ends in a terminal that is electrically connected to one of the electrical connectors;

a plurality of electrical conductors extending between the steam generator and engaging a lower end of each electrical connector in the connection plate; and cooling fluid passage means extending through the packer for circulating cooling fluid pumped down from the surface through the packer and back up the well to the surface.

2. An apparatus for providing electrical power to a downhole steam generator in a cased well, comprising in combination:

a packer supported on a string of tubing and having at least one conduit extending longitudinally through the packer;

setting means in the packer actuable in response to fluid pressure for setting the packer to seal against casing in the well;

setting fluid passage means in the packer for delivering fluid pumped from the surface to the setting means;

a connector box mounted below the lower end of the packer, the connector box having a connector plate containing at least one passage;

a plurality of feed through electrical connectors mounted in insulators in the passage in the connector plate;

support means for mounting the steam generator below the connector box;

an aperture located in the sidewall of the tubing immediately above the packer;

an electrical cable extending from the surface alongside the tubing into the aperture and through the conduit into the connector box, the electrical cable having a plurality of electrical conductors, each of which ends in a terminal that is electrically connected to one of the electrical connectors;

a plurality of electrical conductors extending between the steam generator and engaging a lower end of each electrical connector in the connection plate;

cooling fluid passage means communicating with the setting fluid passage means and extending through the packer to circulate cooling fluid; and blockage means for preventing the circulation of cooling fluid from the setting fluid passage means through the cooling fluid passage means until the setting means has set the packer.

3. An apparatus for providing electrical power to a downhole steam generator in a cased well, comprising in combination:

a packer supported on a string of tubing and having at least one conduit extending longitudinally through the packer;

setting means in the packer actuable in response to fluid pressure for setting the packer to seal against casing in the well;

setting fluid passage means for delivering to the setting means fluid pumped from the surface;

a connector box mounted below the lower end of the packer, the connector box having a connector plate containing at least one passage;

a plurality of feed through electrical connectors mounted in insulators in the passage in the connector plate;

support means for mounting the steam generator below the connector box;

an aperture located in the sidewall of the tubing immediately above the packer;

an electrical cable extending from the surface alongside the tubing into the aperture and through the conduit into the connector box, the electrical cable having a plurality of electrical conductors, each of which ends in a terminal that is electrically connected to one of the electrical connectors;

a plurality of electrical conductors extending between the steam generator and engaging a lower end of each electrical connector in the connection plate; and cooling fluid passage means extending from the setting fluid passage means, through the packer and into contact with the connector box for circulating cooling fluid through the packer and connector box to flow back up the packer to the surface; and blockage means for preventing the circulation of fluid through the setting fluid passage means and the cooling fluid passage means until the setting means has set the packer.

4. An apparatus for providing electrical power to a downhole stem generator in a cased well, comprising in combination;

a packer supported on a string of tubing and having at least one conduit extending longitudinally through the packer;

setting means in the packer actuable in response to fluid pressure delivered from the surface down the tubing for setting the packer to seal against casing in the well;

setting fluid passage means for delivering to the setting means fluid pumped from the surface;

support means for mounting the steam generator below the packer;

an aperture located in the sidewall of the tubing immediately above the packer;

an electrical cable extending from the surface alongside the tubing into the aperture and through the conduit into electrical engagement with the steam generator;

cooling fluid passage means extending from the setting fluid passage through the packer for circulating cooling fluid through the packer to flow back up the packer to the surface; and a disk located in the setting fluid passage downstream of the setting means for blocking fluid pumped from the surface from circulating through the cooling fluid passage means, the disk rupturing at a pressure greater than that required to actuate the setting means, to allow the circulation of fluid from the setting fluid passage means through the cooling fluid passage means once the setting means has set the packer.

5. A method for installing and operating a steam generator in a well, comprising in combination:

mounting a steam generator to the lower end of a packer of a type having at least one conduit extending therethrough and having a setting means that sets the packer against casing in the well when supplied with fluid pressure;

providing the packer with a setting fluid passage leading to the setting means and a cooling fluid passage leading from the setting fluid passage for delivery fluid back out the upper end of the packer;

connecting the packer to a string of tubing which has an aperture in a sidewall located above the packer;

feeding an electrical cable from the steam generator through the conduit in the packer and out the aperture of the tubing;

lowering the packer and steam generator into the well on the tubing;

when at the desired depth, supplying fluid from the surface to the setting fluid passage to set the packer;

blocking the fluid supplied to the setting fluid passage from circulating through the cooling fluid passage until the packer setting means has set; then circulating cooling fluid through the cooling fluid passage, supplying feed water to the steam generator, and supplying electrical power through the cable to the steam generator.

6. A method for installing and operating a steam generator in a well, comprising in combination:

mounting a steam generator to the lower end of a packer of a type having at least one conduit extending therethrough and having a setting means that sets the packer against casing in the well when supplied with fluid pressure;

providing the packer with a setting fluid passage leading to the setting means and a cooling fluid passage leading from the setting fluid passage to the conduit;

connecting the packer to a string of tubing which has an aperture in a sidewall located above the packer;

feeding an electrical cable from the steam generator through the conduit in the packer and out the aperture of the tubing;

lowering the packer and steam generator into the well on the tubing;

when at the desired depth, supplying fluid from the surface down the tubing to the setting fluid passage to set the packer;

preventing with a disk the fluid supplied to the setting fluid passage from circulating through the cooling fluid passage until the packer setting means has set; then increasing the pressure of the fluid supplied to the setting fluid passage to rupture the disk; then circulating cooling fluid down the tubing to flow from the setting fluid passage through the cooling fluid passage and up the packer to the surface; and supplying feed water to the steam generator and electrical power through the cable to the steam generator.

* * * * *

UNITED STATES PATENT AND TRADEMARK OFFICE

CERTIFICATE OF CORRECTION

PATENT NO. : 4,805,698

DATED : February 21, 1989

INVENTOR(S) : John L. Baugh, et al.

It is certified that error appears in the above-identified patent and that said Letters Patent is hereby corrected as shown below:

Column 3, line 45 "dielectri" is changed to--dielectric--;

Column 6, line 14, "101" is changed to--101.--;

Column 7, line 18, "insulations" is changed to--insulators--;

Column 8, line 52, "stem" is changed to--steam;

Column 9, line 30, "delivery" is changed to--delivering--.

Signed and Sealed this

Thirteenth Day of February, 1990

*Attest:*

JEFFREY M. SAMUELS

*Attesting Officer* *Acting Commissioner of Patents and Trademarks*